US005531569A

United States Patent [19]

Seeley

[11] Patent Number: 5,531,569

[45] Date of Patent: Jul. 2, 1996

[54] BUCKET TO WHEEL DOVETAIL DESIGN FOR TURBINE ROTORS

[75] Inventor: Robert E. Seeley, Broadalbin, N.Y.

[73] Assignee: General Electric Company, Schenectady, N.Y.

[21] Appl. No.: 353,037

[22] Filed: Dec. 8, 1994

[51] Int. Cl.[6] ..... F01D 5/32

[52] U.S. Cl. ..... 416/222; 416/219 R; 416/223 A

[58] Field of Search ..... 416/219 A, 219 R, 416/220, 222, 223 A

[56] References Cited

U.S. PATENT DOCUMENTS

| | | |
|---|---|---|
| 2,277,282 | 3/1942 | Flanders . |
| 3,045,968 | 7/1962 | Willis . |
| 3,079,681 | 3/1963 | Fentiman . |
| 4,191,509 | 3/1980 | Leonardi . |
| 4,692,976 | 9/1987 | Andrews . |
| 4,702,673 | 10/1987 | Hansen et al. . |
| 4,824,328 | 4/1989 | Pisz et al. . |
| 5,147,180 | 9/1992 | Johnson . |
| 5,160,242 | 11/1992 | Brown . |
| 5,176,500 | 1/1993 | Heinig . |

FOREIGN PATENT DOCUMENTS

| | | |
|---|---|---|
| 2238581 | 6/1991 | United Kingdom . |

*Primary Examiner*—F. Daniel Lopez
*Assistant Examiner*—Mark Sgantzos
*Attorney, Agent, or Firm*—Nixon & Vanderhye

[57] ABSTRACT

In a steam turbine rotor wheel and bucket dovetail joint construction wherein the wheel dovetail includes a plurality of radially adjacent hooks interconnected by respective necks, each having an upper and lower fillet pair of substantially identical fillet, an improvement wherein each upper fillet has a compound radius.

10 Claims, 2 Drawing Sheets

FIG. 4
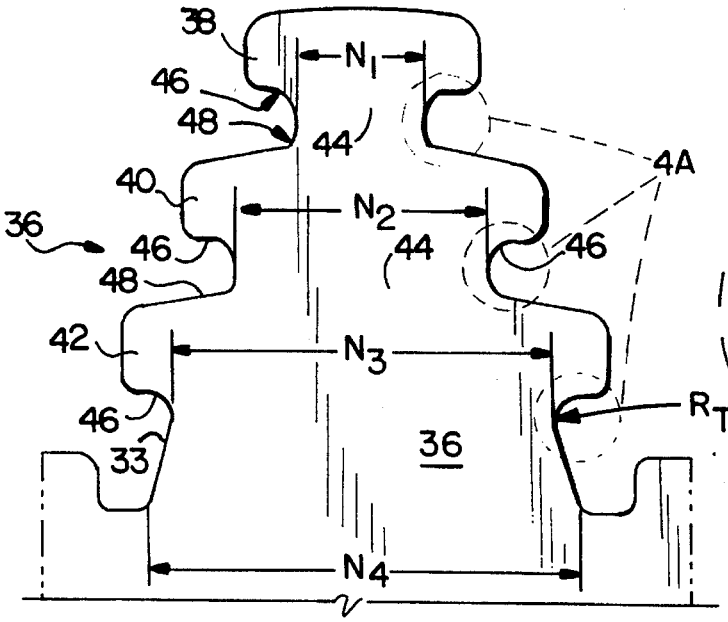
FIG. 4A
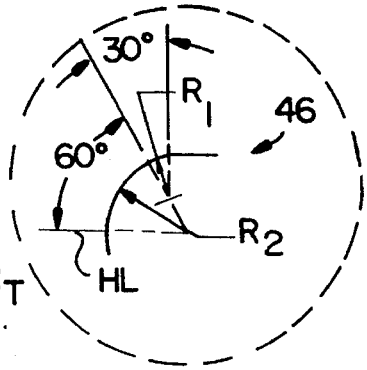
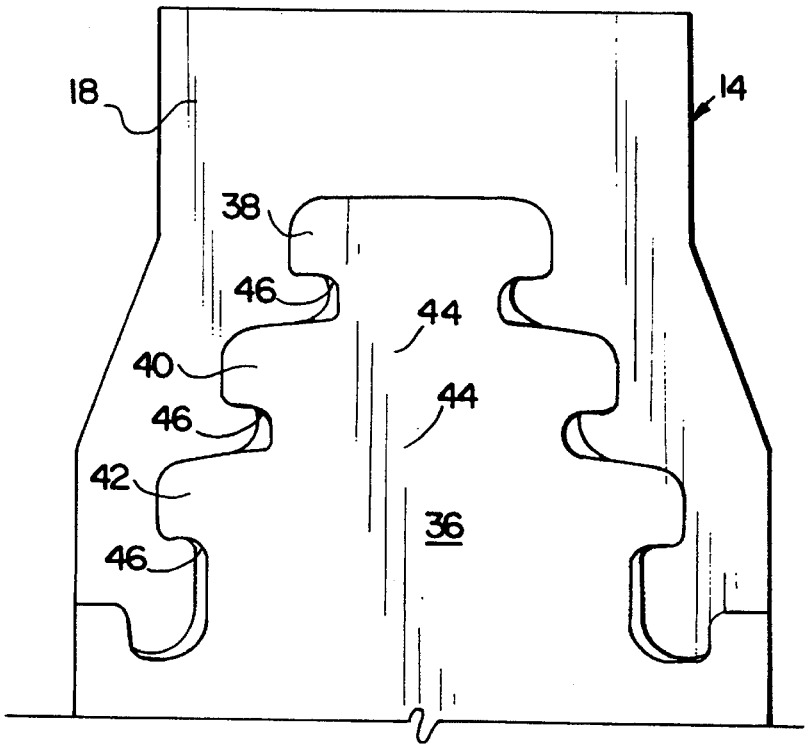
FIG. 5

BUCKET TO WHEEL DOVETAIL DESIGN FOR TURBINE ROTORS

TECHNICAL FIELD

This invention relates to steam turbines in general, and to the dovetail attachment between steam turbine rotors and steam turbine buckets in particular.

BACKGROUND

Dovetail attachment techniques between turbine buckets and turbine rotor wheels are well known in the art. It has been found, however, that conventional tangential entry dovetails on the latter stages of low pressure rotors operate in an environment that is conducive to stress corrosion cracking (SCC). SCC is accelerated by the stress levels that are present in the hook fillet region of typical dovetail configurations. Normally, these stresses are acceptable, but in contaminated steam, cracks can initiate and, if left undetected, can grow to a depth that may cause failure of the wheel hooks. In extreme cases, all of the hooks may fail and buckets may fly loose from the rotor.

It has been found generally that the cracking problem described above occurs primarily in wheel hooks rather than in the complementary bucket hooks. This is apparently because the NiCrMoV steels used for low pressure rotors are much less resistant to SCC than are the 12 Cr steels used for buckets. NiCrMoV steels, however, give the optimum combination of properties available for overall low pressure rotor design considerations. Therefore, the most effective means of avoiding SCC in the typical low pressure steam environment is not to change materials but, rather, to reduce the stresses in the wheel dovetail to acceptable levels. Thus, if the maximum stress in components operating in a corrosive environment is reduced below the yield strength of the material, the resistance to SCC is greatly improved.

DISCLOSURE OF THE INVENTION

It is the principal object of this invention to provide a bucket to rotor wheel dovetail attachment configuration for low pressure rotors that have peak stresses in the wheel hook fillets that are low enough to avoid SCC in the wheel hooks. At the same time, it is also an object to maintain an overall wheel hook configuration that is compatible with existing bucket dovetails to thereby allow continued use of existing buckets and bucket dovetail cutters.

Before describing the invention, a brief discussion of dovetail terminology will be helpful. Each wheel dovetail is formed with a plurality of "hooks" arranged in horizontal pairs extending laterally in opposite directions, and spaced vertically by relatively narrow "necks" of specified height and width. The wheel dovetail receives a bucket dovetail of complementary shape. It is accepted practice to describe dovetails in terms of one half of the design, due to symmetry about a radial (or vertical, when considered in connection with the drawings) plane. Accordingly, a dovetail which is formed with, for example, three vertically spaced pairs of hooks, is referred to as a three hook dovetail. Each neck portion between any two vertically spaced pairs of wheel hooks is joined to the adjacent upper and lower hooks at respective upper and lower "fillets". The lowermost (or radially innermost) hook is joined to a modified neck portion which merges into a "tang" portion at the lowermost (or radially innermost) end of the dovetail. Thus, the lowermost hook will be considered, for purposes of discussion here, to have associated therewith only an upper fillet which merges downwardly into the "tang" portion.

In accordance with an exemplary embodiment of this invention, the wheel dovetails incorporate compound upper fillets, as opposed to single radius fillets used in conventional dovetails. Lower fillet radii have also been reduced. The compound radius fillets reduce concentrated stress which, in turn, improves resistance to stress corrosion cracking (SCC) in the wheel dovetails of steam turbine rotors. In addition, the new wheel dovetail designs of this invention are compatible with conventional bucket dovetails. As a result, there is no need for new cutters to manufacture mating bucket dovetails, and modification of in-service rotors is permitted without replacement of the buckets.

The new wheel dovetails in accordance with this invention can be used with special long-shank buckets to eliminate in-service cracks in dovetails of any rotor that will accommodate the geometry (e.g., wheel width, dovetail height). It is also an alternate design for any of the wheels already installed on new rotors.

Additional objects and advantages of the invention will become apparent from the detailed description which follows.

BRIEF DESCRIPTION OF THE DRAWINGS

FIG. 4 is a side section of a wheel dovetail in accordance with an exemplary embodiment of this invention;

FIG. 4A is an enlarged detail illustrating the upper compound fillet where the wheel necks join with respective wheel hooks in accordance with the invention; and FIG. 5 is a partial side section illustrating the manner in which the wheel dovetail in accordance with this invention mates with a conventional bucket dovetail.

BEST MODE FOR CARRYING OUT THE INVENTION

Figure 1:
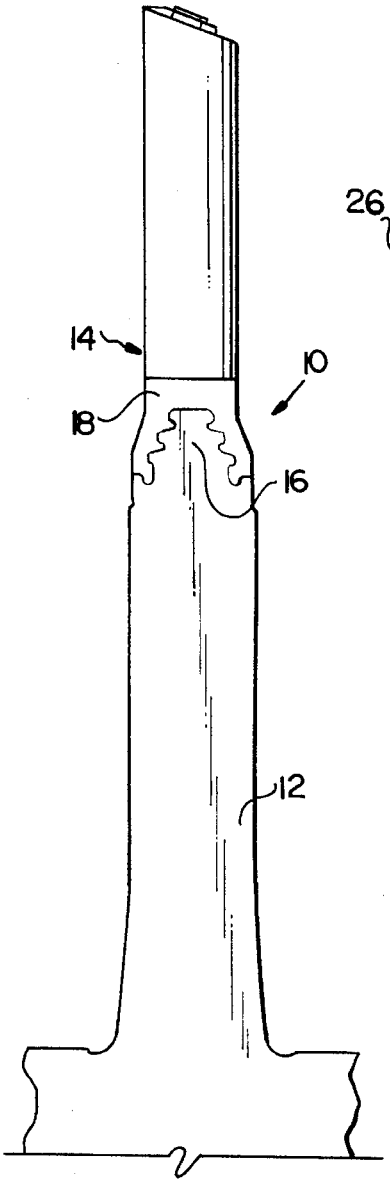
FIG. 1 (PRIOR ART)
FIG. 1 is a side elevation partly in section of a rotor body, rotor wheel and bucket incorporating a wheel/bucket dovetail in a conventional prior art arrangement.

FIG. 1 illustrates generally a conventional dovetail joint 10 between a turbine rotor wheel 12 and a turbine bucket 14. The wheel dovetail 16 is formed integrally with the wheel 12 and typically permits mounting of bucket 14 via a complementary or mating bucket dovetail 18 in a "tangential entry" configuration which, per se, is well known.

Consistent with the terminology discussed above, and with further reference to FIG. 2, the conventional dovetail 16 is formed with three hooks 20, 22 and 24, along with a tang portion 26 at the base of the dovetail. The respective radially adjacent hooks are connected via necks 28 (mated with bucket dovetail projections 28') having upper and lower fillets 30, 32, respectively, and it is in this area that the present invention provides improved performance. The relatively snug fit between the wheel and bucket dovetails is apparent from FIG. 3, and, for the sake of convenience, the corresponding bucket hook recesses are referenced by numerals 20', 22' and 24'.

Figure 2:
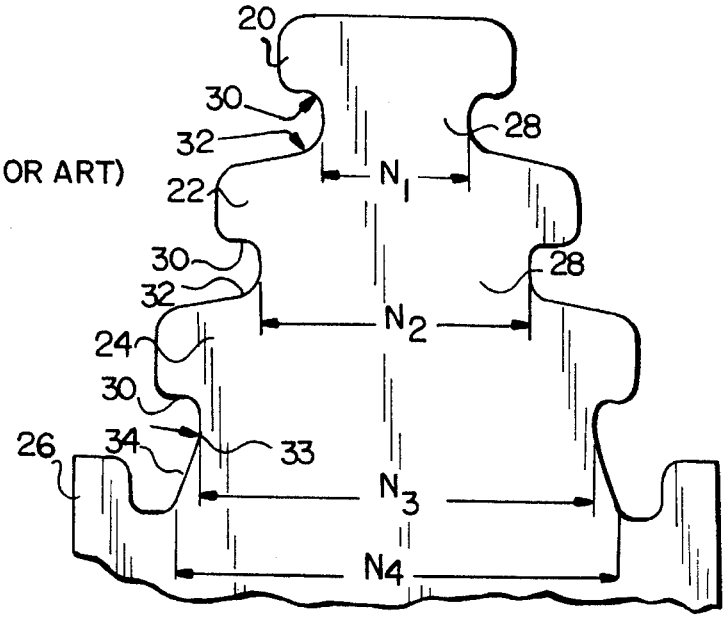
FIG. 2 (PRIOR ART)
FIG. 2 is an enlarged detail illustrating a conventional wheel dovetail of the type shown in FIG. 1.
Figure 3:
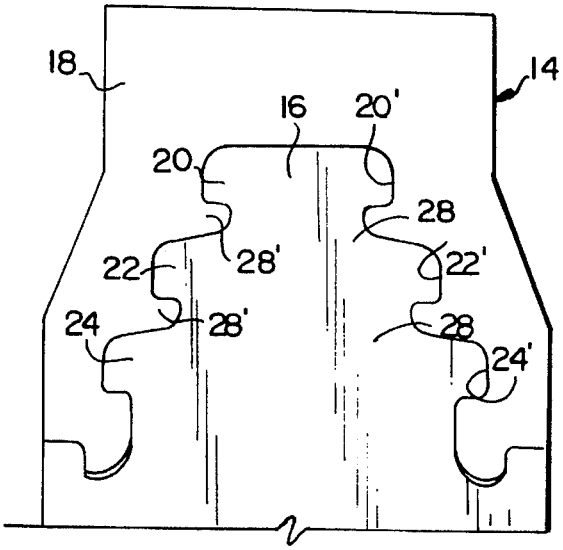
FIG. 3 (PRIOR ART)
FIG. 3 is an enlarged detail illustrating the mating engagement of the conventional bucket and wheel dovetail arrangement shown in FIG. 1.

FIG. 2 illustrates in more detail the conventional mating wheel dovetail 16 as shown also in FIGS. 1 and 3, and typical dimensions for the neck regions $N_2$, $N_2$ and $N_3$ are as follows:

$N_1=0.617\ ^{+0.002}_{-0.000}$ $N_2=1.155\ ^{+0.002}_{-0.000}$ $N_3=1.705\ ^{+0.002}_{-0.000}$ $N_4=1.955\ ^{+0.002}_{-0.000}$

In this same wheel dovetail, each upper fillet 30 has a single radius $R_u$=0.075 inch and each lower fillet 32 has a single radius $R_L$=0.125 inch. At the lower (or radially innermost) hook, a third radius $R_T$ located at 33 merges the respective upper fillet 30 into a straight taper 34 which joins to the tang portion 26. In the conventional wheel dovetail shown, $R_T$=0.125 inch.

FIGS. 4 and 4A illustrate a new turbine wheel dovetail configuration in accordance with this invention. For convenience, only those dimensions which have been changed are referenced in the drawings and discussed below.

The new wheel dovetail 36 in accordance with this invention is shown in FIGS. 4 and 4A and includes upper, intermediate and lower hooks 38, 40 and 42, respectively, with the radially adjacent hooks each being interconnected by a neck 44 having an upper fillet 46 and a lower fillet 48. In accordance with this invention, the upper fillet 46 of each neck is formed with a compound radius, best shown in the enlarged detail of FIG. 4A. Specifically, the upper fillet 46 is formed with a first smaller radius $R_1$ extending over the first 30° of the fillet, commencing from the adjacent lower edge of the hook immediately above. In the exemplary embodiment, $R_1$ is 0.075 inch. A second radiused portion $R_2$ of the upper fillet 46 extends over the following 60° (as measured from the termination of $R_1$ in a direction toward the lower fillet. In the exemplary embodiment, $R_2$=0.150 inch. The two radii are drawn on different centers, as determined by the existing hook geometry. Thus, given the $R_2$ radius of 0.150 inch extending 60° clockwise from the horizontal reference line HL, and given an $R_1$ value of 0.075 inch and the existing hook geometry, the center for radius $R_1$ can be determined. In the exemplary embodiment where $R_1$ is half $R_2$, the center for $R_1$ lies halfway along the radius $R_2$ as best seen in FIG. 4A. The design is such that the larger radiused portion of the fillet extending over the 60° arc as shown, spans the region of peak stress. In this exemplary embodiment, $R_L'$ is 0.075 in.

The above described fillet geometry produces the following new neck dimensions for the exemplary embodiment.

$N_1'$=0.542 inch $N_2'$=1.080 inch $N_3'$=1.630 inch $N_4'$=1.853 inch

A finite element analysis of this first wheel dovetail embodiment yielded a 19% lower peak stress as compared to the original design.

It will be understood that the above discussion relates only to dimensions for a dovetail construction for a specific bucket and wheel configuration. Similar design modifications can be made for other bucket and wheel configurations. For example, in a second exemplary embodiment, existing applicable neck and radius dimensions for the conventional wheel bucket are as follows:

(2) $N_1$=0.632 inch (2) $N_2$=1.170 inch (2) $N_3$=1.720 inch (2) $N_4$=1.970 inch (2) $R_U$=0.075 inch (2) $R_L$=0.125 inch (2) $R_T$=0.250 inch In this second exemplary embodiment, new corresponding neck and radius dimensions are as follows:

(2) $N_1'$=0.557 inch (2) $N_2'$=1.095 inch (2) $N_3'$=1.645 inch (2) $N_4'$=1.853 inch (2) $R_1'$=0.075 inch (2) $R_2'$=0.150 inch (2) $R_L'$=0.075 inch (2) $R_T'$=0.250 inch A finite element analysis of this second wheel dovetail embodiment yielded a 22% lower peak stress as compared to the original.

In a third exemplary embodiment, the existing applicable dimensions for the conventional wheel bucket are as follows:

(3) $N_1$=0.690 inch (3) $N_2$=1.220 inch (3) $N_3$=1.750 inch (3) $R_U$=0.062 inch (3) $R_L$=0.188 inch (3) $R_T$=0.250 inch In this third exemplary embodiment, corresponding new dimensions are as follows:

(3) $N_1'$=0.589 inch (3) $N_2'$=1.119 inch (3) $N_3'$=1.649 inch (3) $R_1'$=0.075 inch (3) $R_2'$=0.150 inch (3) $R_L'$=0.075 inch (3) $R_T'$=0.250 inch A finite element analysis of this third wheel dovetail embodiment yielded a 28% lower peak stress as compared to the original. By utilizing the above described upper compound radius fillet, advantage is taken of the fact that peak stress decreases as size of the hook fillet increases. At the same time, along with the reduced lower fillet radius, the aforementioned relationship is maximized in a minimal transition distance, i.e., the distance from the bottom surface of the hook to the dovetail neck surface. In other words, by increasing the fillet radius only in the region of peak stress, the transition distance is minimized, and thus reduction in neck thickness and attendant increase in neck stress is also minimized. In addition, the compound fillet effectively increases the fillet radius in the region of peak stress without also causing interference with the mating bucket dovetail of original shape, best seen in FIG. 5.

Specific dimensions provided herein are exemplary only and are not intended to limit the scope of the claims. In other words, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a steam turbine rotor wheel and bucket dovetail joint construction wherein the wheel dovetail includes a plurality of radially adjacent hooks interconnected by respective necks, each having an upper and lower fillet, the improvement wherein each upper fillet has a compound radius.

2. The improvement of claim 1 wherein said upper fillet has a first upper radius of approximately 0.075 in. extending about 30° from a vertical reference and a second lower radius of approximately 0.150 in. extending about 60° from the first radius to a horizontal reference.

3. The improvement of claim 1 wherein the lower fillet has a radius of approximately 0.075 in.

4. The improvement of claim 1 wherein said dovetail is a three hook dovetail.

5. The improvement of claim 1 wherein said upper fillet has a first upper radius and a second lower radius, said first radius approximately ½ said second radius.

6. The improvement of claim 2 wherein said upper and lower radii of said upper fillet are drawn on different centers.

7. The improvement of claim 1 wherein said compound radius fillet includes at least two radii drawn on different centers.

8. The improvement of claim 1 wherein said dovetail joint construction includes from 2 to 4 hooks.

9. The improvement of claim 1 wherein said upper fillet has a first upper radius of approximately 0.075 in. extending about 30° from a vertical reference and a second lower radius of approximately 0.150 in. extending about 60° from the first radius to a horizontal reference; and wherein the lower fillet has a radius of approximately 0.075 in.

10. In a steam turbine rotor wheel and bucket dovetail joint construction wherein the wheel dovetail includes a plurality of radially adjacent hooks interconnected by respective necks, each having an upper and lower fillet, the improvement wherein each upper fillet has a compound radius; wherein said upper fillet has a first upper radius and a second lower radius, said first radius approximately ½ said second radius; and wherein said upper and lower radii are drawn on different centers.

* * * * *